US012241195B2

(12) United States Patent
Phelps et al.

(10) Patent No.: US 12,241,195 B2
(45) Date of Patent: Mar. 4, 2025

(54) WASHING MACHINE APPLIANCE LOAD SIZE DETECTION USING POWER AND BALANCE

(71) Applicant: Haier US Appliance Solutions, Inc., Wilmington, DE (US)

(72) Inventors: Stannard Nathan Phelps, Louisville, KY (US); Darrin R. Smith, Louisville, KY (US); Adam Berry, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 303 days.

(21) Appl. No.: 17/751,865

(22) Filed: May 24, 2022

(65) Prior Publication Data

US 2023/0383454 A1 Nov. 30, 2023

(51) Int. Cl.

| | |
|---|---|
| ***D06F 34/18*** | (2020.01) |
| ***D06F 33/32*** | (2020.01) |
| ***D06F 33/48*** | (2020.01) |
| ***D06F 34/16*** | (2020.01) |
| ***D06F 37/30*** | (2020.01) |
| *D06F 33/52* | (2020.01) |
| *D06F 33/76* | (2020.01) |

(Continued)

(52) U.S. Cl.

CPC ..... *D06F 34/18* (2020.02); *D06F 33/32* (2020.02); *D06F 33/48* (2020.02); *D06F 34/16* (2020.02); *D06F 37/304* (2013.01); *D06F 33/52* (2020.02); *D06F 33/76* (2020.02); *D06F 2103/04* (2020.02); *D06F 2103/24* (2020.02); *D06F 2103/26* (2020.02); *D06F 2103/46* (2020.02); *D06F 2105/00* (2020.02); *D06F 2105/48* (2020.02); *D06F 2105/52* (2020.02)

(58) Field of Classification Search

CPC ..... D06F 33/32; D06F 33/48; D06F 33/52; D06F 33/76; D06F 34/16; D06F 34/18; D06F 37/304; D06F 2103/04; D06F 2103/24; D06F 2103/26; D06F 2103/46; D06F 2105/48; D06F 2105/52

See application file for complete search history.

(56) References Cited

U.S. PATENT DOCUMENTS

| | | | |
|---|---|---|---|
| 8,042,211 | B2 | 10/2011 | Stansel et al. |
| 8,813,288 | B2 | 8/2014 | Bhandwale et al. |

(Continued)

FOREIGN PATENT DOCUMENTS

| | | | |
|---|---|---|---|
| WO | WO2014/191248 | A1 | 12/2014 |
| WO | WO2020/050621 | A1 | 3/2020 |

*Primary Examiner* — Joseph L. Perrin

(74) *Attorney, Agent, or Firm* — Dority & Manning, P.A.

(57) ABSTRACT

A washing machine appliance and methods of operating a washing machine appliance are provided. The washing machine appliance includes a motor and a rotatable basket. The motor is operated to rotate the basket. While operating the motor to rotate the basket, a power consumption and a balance condition of a load of articles in the basket are determined. A size of the load of articles in the basket of the washing machine appliance is determined based on the power consumption and the balance condition. Based on the determined size of the load, one or more operating parameters of the washing machine appliance are selected and an operation of the washing machine appliance is performed according to the one or more selected operating parameters.

20 Claims, 10 Drawing Sheets

(51) Int. Cl.

| | |
|---|---|
| *D06F 103/04* | (2020.01) |
| *D06F 103/24* | (2020.01) |
| *D06F 103/26* | (2020.01) |
| *D06F 103/46* | (2020.01) |
| *D06F 105/00* | (2020.01) |
| *D06F 105/48* | (2020.01) |
| *D06F 105/52* | (2020.01) |

(56) References Cited

U.S. PATENT DOCUMENTS

| | | | | |
|---|---|---|---|---|
| 8,932,369 | B2 | 1/2015 | Miller et al. | |
| 9,080,276 | B2 | 7/2015 | Peterson et al. | |
| 9,096,964 | B2 | 8/2015 | Albayrak et al. | |
| 9,122,549 | B2 | 9/2015 | Canton | |
| 9,200,401 | B2 | 12/2015 | Chung et al. | |
| 9,371,607 | B2 | 6/2016 | Pascualena et al. | |
| 9,863,080 | B2 | 1/2018 | Fugal et al. | |
| 9,890,490 | B2 | 2/2018 | Janke et al. | |
| 10,041,202 | B2 | 8/2018 | Sumer et al. | |
| 10,047,470 | B2 | 8/2018 | Kim et al. | |
| 10,301,762 | B2 | 5/2019 | Sumer et al. | |
| 10,619,286 | B2 | 4/2020 | Pesavento et al. | |
| 11,111,619 | B2 | 9/2021 | Davis | |
| 2008/0178398 | A1 | 7/2008 | Darby et al. | |
| 2015/0134125 | A1* | 5/2015 | Dedow | D06F 37/36 700/279 |
| 2022/0190763 | A1* | 6/2022 | Han | H02P 27/06 |

* cited by examiner

WASHING MACHINE APPLIANCE LOAD SIZE DETECTION USING POWER AND BALANCE

FIELD OF THE INVENTION

The present subject matter relates generally to washing machine appliances and methods for operating washing machine appliances, and more particularly to systems and methods for detecting a size of a load of articles in such appliances.

BACKGROUND OF THE INVENTION

Washing machine appliances generally include a tub for containing washing fluid, e.g., water, detergent, and/or bleach, during operation of such washing machine appliances. A basket is rotatably mounted within the tub and defines a wash chamber for receipt of articles for washing. During operation of such washing machine appliances, washing fluid is directed into the tub and onto articles within the wash chamber of the basket. The basket can rotate at various speeds to agitate articles within the wash chamber in the washing fluid, to wring washing fluid from articles within the wash chamber, etc. Washing machine appliances include vertical axis washing machine appliances and horizontal axis washing machine appliances, where "vertical axis" and "horizontal axis" refer to the axis of rotation of the wash basket within the wash tub.

A concern during operation of washing machine appliances is the balance of the basket and contents thereof, e.g., a load of articles and wash liquid, during operation. For example, the articles and wash liquid within the basket may not be equally weighted about a central axis of the basket and tub. Accordingly, when the basket rotates, in particular during a spin cycle, the imbalance in weight may cause the basket to be out-of-balance within the tub, such that the axis of rotation does not align with the central axis of the basket or tub. Such out-of-balance issues during rotation of the basket can cause excessive noise, vibration or motion, or other undesired conditions.

Further, a type of the load of articles, e.g., a material type and the absorbency of the material of the articles, may influence the behavior of the articles and wash liquid during the spin cycle. In particular, when the load includes one or more non-shedding articles, e.g., articles which are waterproof or very low water absorbency, wash liquid may be retained within the basket up to a certain rotational speed (such as entrapped within folds of a non-shedding article) and then, as the rotation accelerates, the wash liquid may be rapidly displaced within or from the basket, causing a sudden shift in the center of mass of the contents of the basket. Such shifting of the center of mass may result in an increased likelihood of an out-of-balance condition.

Accordingly, a laundry appliance having improved features for determining whether a load of articles therein includes non-shedding articles would be desired.

BRIEF DESCRIPTION OF THE INVENTION

Aspects and advantages of the invention will be set forth in part in the following description, or may be obvious from the description, or may be learned through practice of the invention.

In one aspect of the present disclosure, a method of operating a washing machine appliance is provided. The method includes operating a motor of the washing machine appliance in order to rotate a basket of the washing machine appliance. The method also includes determining a power consumption while operating the motor of the washing machine appliance in order to rotate the basket of the washing machine appliance and determining a balance condition of a load of articles in the basket while operating the motor of the washing machine appliance in order to rotate the basket of the washing machine appliance. The method further includes determining a size of the load of articles in the basket of the washing machine appliance based on the power consumption and the balance condition. Based on the determined size of the load, one or more operating parameters of the washing machine appliance are selected and the method also includes performing an operation of the washing machine appliance according to the one or more selected operating parameters.

In another aspect of the present disclosure, a washing machine appliance is provided. The washing machine appliance includes a basket rotatably mounted within the washing machine appliance and a motor coupled to the basket whereby the motor is operable for rotating the basket. The washing machine appliance also includes a controller. The controller is in operative communication with the motor. The controller is configured for operating the motor of the washing machine appliance in order to rotate the basket of the washing machine appliance. The controller is also configured for determining a power consumption while operating the motor of the washing machine appliance in order to rotate the basket of the washing machine appliance and determining a balance condition of a load of articles in the basket while operating the motor of the washing machine appliance in order to rotate the basket of the washing machine appliance. The controller is further configured for determining a size of the load of articles in the basket of the washing machine appliance based on the power consumption and the balance condition. Based on the size of the load, the controller is configured for selecting one or more operating parameters of the washing machine appliance and the controller is also configured for performing an operation of the washing machine appliance according to the one or more selected operating parameters.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
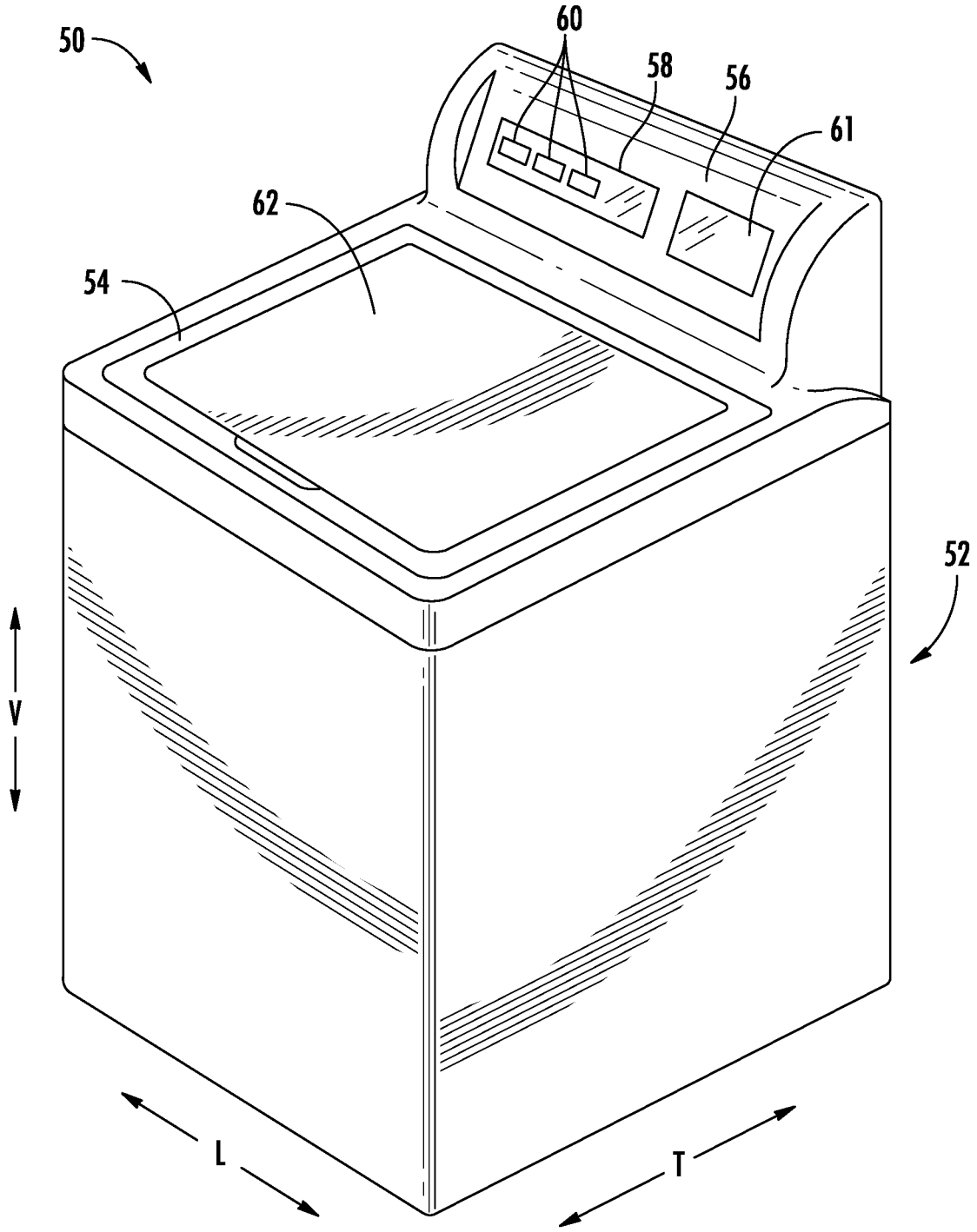
FIG. 1 provides a perspective view of a washing machine appliance according to one or more exemplary embodiments of the present subject matter.

Reference now will be made in detail to embodiments of the invention, one or more examples of which are illustrated in the drawings. Each example is provided by way of explanation of the invention, not limitation of the invention. In fact, it will be apparent to those skilled in the art that various modifications and variations can be made in the present invention without departing from the scope or spirit of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, terms of approximation, such as "substantially," "generally," or "about" include values within ten percent greater or less than the stated value. When used in the context of an angle or direction, such terms include within ten degrees greater or less than the stated angle or direction. For example, "generally vertical" includes directions within ten degrees of vertical in any direction, e.g., clockwise or counter-clockwise.

As used herein, the terms "articles," "clothing," or "laundry" include but need not be limited to fabrics, textiles, garments, linens, papers, or other items which may be cleaned, dried, and/or otherwise treated in a laundry appliance. Furthermore, the term "load" or "laundry load" refers to the combination of clothing that may be washed together in a washing machine appliance or dried together in a dryer appliance (e.g., clothes dryer), including washed and dried together in a combination laundry appliance, and may include a mixture of different or similar articles of clothing of different or similar types and kinds of fabrics, textiles, garments and linens within a particular laundering process.

FIG. 1 is a perspective view of a washing machine appliance 50 according to an exemplary embodiment of the present subject matter. As illustrated, washing machine appliance 50 generally defines a vertical direction V, a lateral direction L, and a transverse direction T, each of which is mutually perpendicular, such that an orthogonal coordinate system is generally defined. As may be seen in FIG. 1, washing machine appliance 50 includes a cabinet 52 and a cover 54. A backsplash 56 extends from cover 54, and a control panel 58 including a plurality of input selectors 60 is coupled to backsplash 56. Control panel 58 and input selectors 60 collectively form a user interface input for operator selection of machine cycles and features, and in one embodiment, a display 61 indicates selected features, a countdown timer, and/or other items of interest to machine users. A lid 62 is mounted to cover 54 and is rotatable between an open position (not shown) facilitating access to a wash tub 64 (FIG. 2) located within cabinet 52 and a closed position (shown in FIG. 1) forming an enclosure over wash tub 64.

Figure 2:
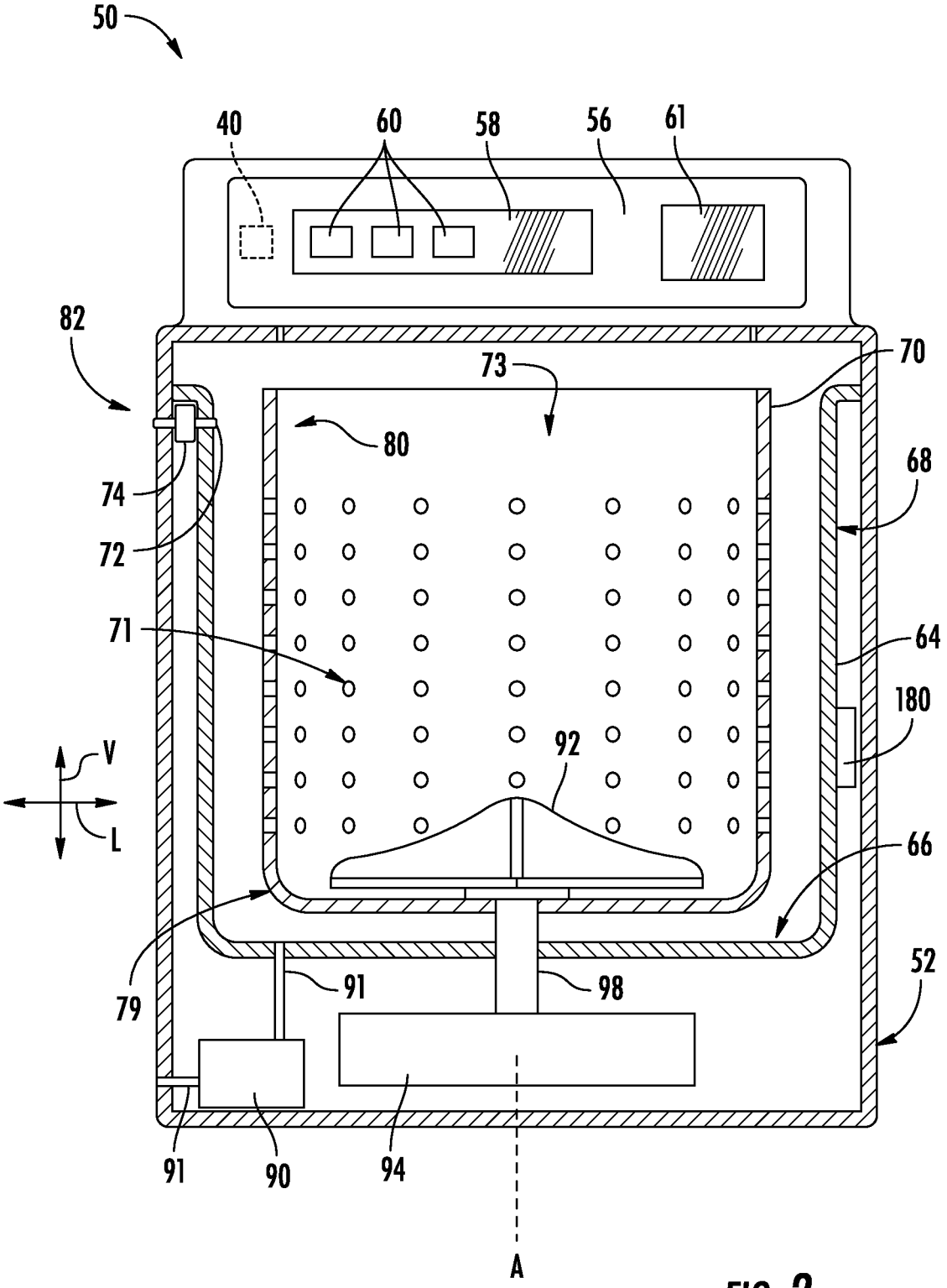
FIG. 2 provides a front, section view of the exemplary washing machine appliance of FIG. 1.

FIG. 2 provides a front, cross-section view of washing machine appliance 50. As may be seen in FIG. 2, wash tub 64 includes a bottom wall 66 and a sidewall 68. A wash basket 70 is rotatably mounted within wash tub 64. In particular, wash basket 70 is rotatable about an axis of rotation A which, in the illustrated embodiment of FIGS. 1 and 2, is generally parallel to the vertical direction V. Thus, washing machine appliance 50 may be referred to as a vertical axis washing machine appliance. Wash basket 70 defines a wash chamber 73 for receipt of articles for washing and extends, e.g., vertically, between a bottom portion 79 and a top portion 80. Wash basket 70 includes a plurality of perforations 71 therein to facilitate fluid communication between an interior of wash basket 70 and wash tub 64.

A spout 72 is configured for directing a flow of fluid into wash tub 64. In particular, spout 72 may be positioned at or adjacent top portion 80 of wash basket 70. Spout 72 may be in fluid communication with a water supply (not shown) in order to direct fluid (e.g., clean water) into wash tub 64 and/or onto articles within wash chamber 73 of wash basket 70. A valve 74 regulates the flow of fluid through spout 72. For example, valve 74 can selectively adjust to a closed position in order to terminate or obstruct the flow of fluid through spout 72. A pump assembly 90 (shown schematically in FIG. 2) is located beneath tub 64 and wash basket 70 for gravity assisted flow from wash tub 64. Pump 90 may be positioned along or in operative communication with a drain line 91 which provides fluid communication from the wash chamber 73 of the basket 70 to an external conduit, such as a wastewater line (not shown). In some embodiments, the pump 90 may also or instead be positioned along or in operative communication with a recirculation line (not shown) which extends back to the tub 64, e.g., in addition to the drain line 91.

An agitation element 92, shown as an impeller in FIG. 2, is disposed in wash basket 70 to impart an oscillatory motion to articles and liquid in wash chamber 73 of wash basket 70. In various exemplary embodiments, agitation element 92 includes a single action element (i.e., oscillatory only), double action (oscillatory movement at one end, single direction rotation at the other end) or triple action (oscillatory movement plus single direction rotation at one end, single direction rotation at the other end). As illustrated in FIG. 2, agitation element 92 is oriented to rotate about axis of rotation A. Wash basket 70 and agitation element 92 are driven by a pancake motor 94. As motor output shaft 98 is rotated, wash basket 70 and agitation element 92 are operated for rotatable movement within wash tub 64, e.g., about the axis of rotation A. Washing machine appliance 50 may also include a brake assembly (not shown) selectively applied or released for respectively maintaining wash basket 70 in a stationary position within wash tub 64 or for allowing wash basket 70 to spin within wash tub 64.

Operation of washing machine appliance 50 is controlled by a processing device or controller 40 that is operatively coupled to the user interface input located on washing machine backsplash 56 for user manipulation to select washing machine cycles and features. In response to user manipulation of the user interface input, controller 40 operates the various components of washing machine appliance 50 to execute selected machine cycles and features.

Controller 40 may include a memory and microprocessor, such as a general or special purpose microprocessor operable to execute programming instructions or micro-control code associated with a cleaning cycle. The memory may represent random access memory such as DRAM, or read only memory such as ROM or FLASH. In one embodiment, the processor executes programming instructions stored in memory. The memory may be a separate component from the processor or may be included onboard within the processor. Alternatively, controller 40 may be constructed without using a microprocessor, e.g., using a combination of discrete analog and/or digital logic circuitry (such as switches, amplifiers, integrators, comparators, flip-flops, AND gates, and the like) to perform control functionality instead of relying upon software. Control panel 58 and other components of washing machine appliance 50 may be in communication with controller 40 via one or more signal lines or shared communication busses. In particular, controller 40 may be communicatively coupled with one or more sensors, e.g., a temperature sensor, pressure sensor, etc., and/or measurement devices, such as measurement device 180 illustrated in FIG. 2 and described in more detail below.

In an illustrative embodiment, laundry items are loaded into wash chamber 73 of wash basket 70, and washing operation is initiated through operator manipulation of control input selectors 60. Wash tub 64 is filled with water and mixed with detergent to form a wash fluid. Valve 74 can be opened to initiate a flow of water into wash tub 64 via spout 72, and wash tub 64 can be filled to the appropriate level for the amount of articles being washed. Once wash tub 64 is properly filled with wash fluid, the contents of the wash basket 70 are agitated with agitation element 92 for cleaning of laundry items in wash basket 70. More specifically, agitation element 92 is moved back and forth in an oscillatory motion. The wash fluid may be recirculated through the washing machine appliance 50 at various points in the wash cycle, such as before or during the agitation phase (as well as one or more other portions of the wash cycle, separately or in addition to before and/or during the agitation phase).

After the agitation phase of the wash cycle is completed, wash tub 64 is drained. Laundry articles can then be rinsed by again adding fluid to wash tub 64, depending on the particulars of the cleaning cycle selected by a user, agitation element 92 may again provide agitation within wash basket 70. One or more spin cycles may also be used. In particular, a spin cycle may be applied after the wash cycle and/or after the rinse cycle in order to wring wash fluid from the articles being washed. During a spin cycle, wash basket 70 is rotated at relatively high speeds. In various embodiments, the pump 90 may be activated to drain liquid from the washing machine appliance 50 during the entire drain phase (or the entirety of each drain phase, e.g., between the wash and rinse and/or between the rinse and the spin) and may be activated during one or more portions of the spin cycle.

While described in the context of a specific embodiment of washing machine appliance 50, using the teachings disclosed herein it will be understood that washing machine appliance 50 is provided by way of example only. Other washing machine appliances having different configurations (such as horizontal-axis washing machine appliances), different appearances, and/or different features may also be utilized with the present subject matter as well. For example, FIGS. 3 and 4 illustrate one such possible variant in the form of a horizontal-axis washing machine appliance 100.

Figure 3:
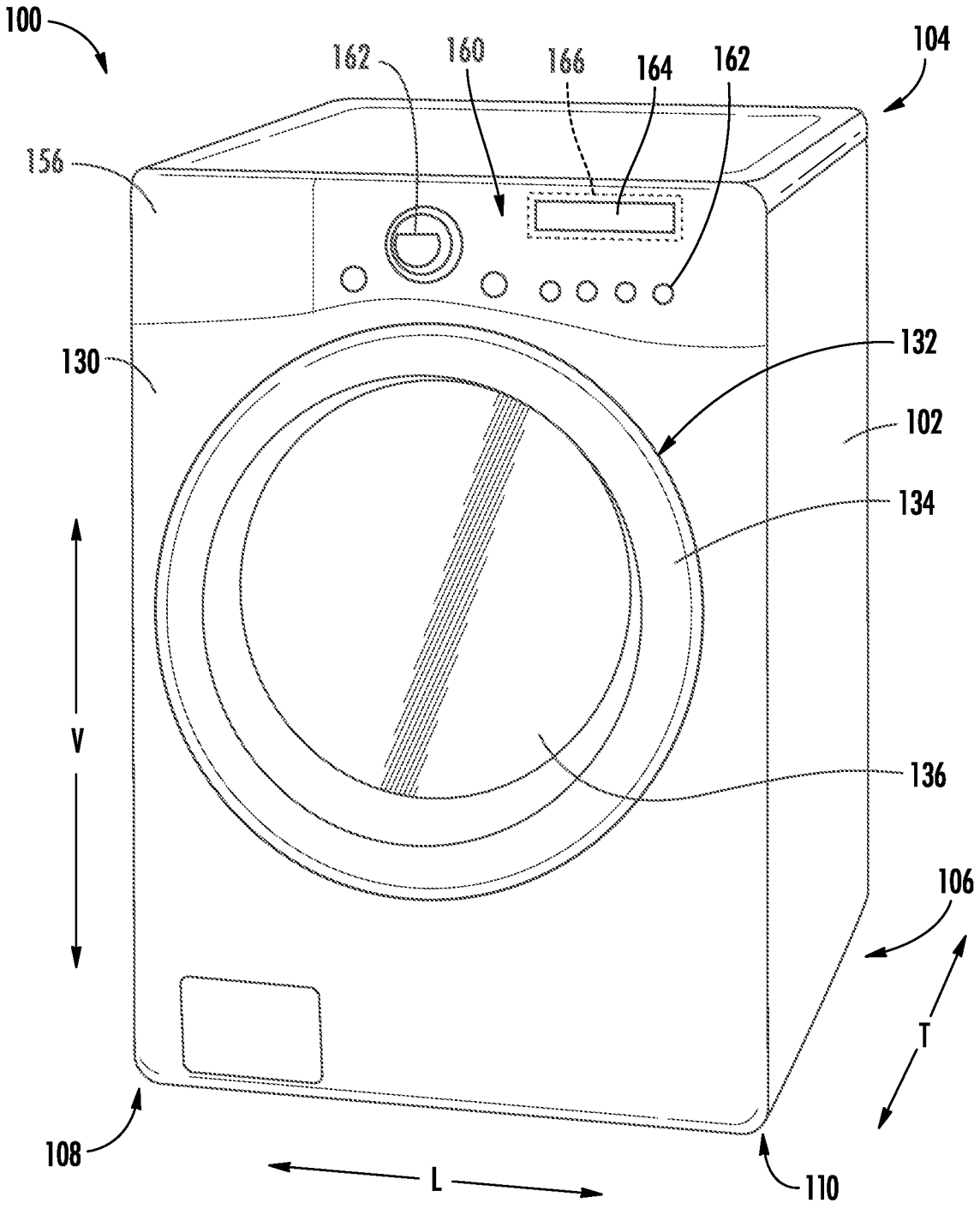
FIG. 3 provides a perspective view of a washing machine appliance according to additional exemplary embodiments of the present disclosure.
Figure 4:
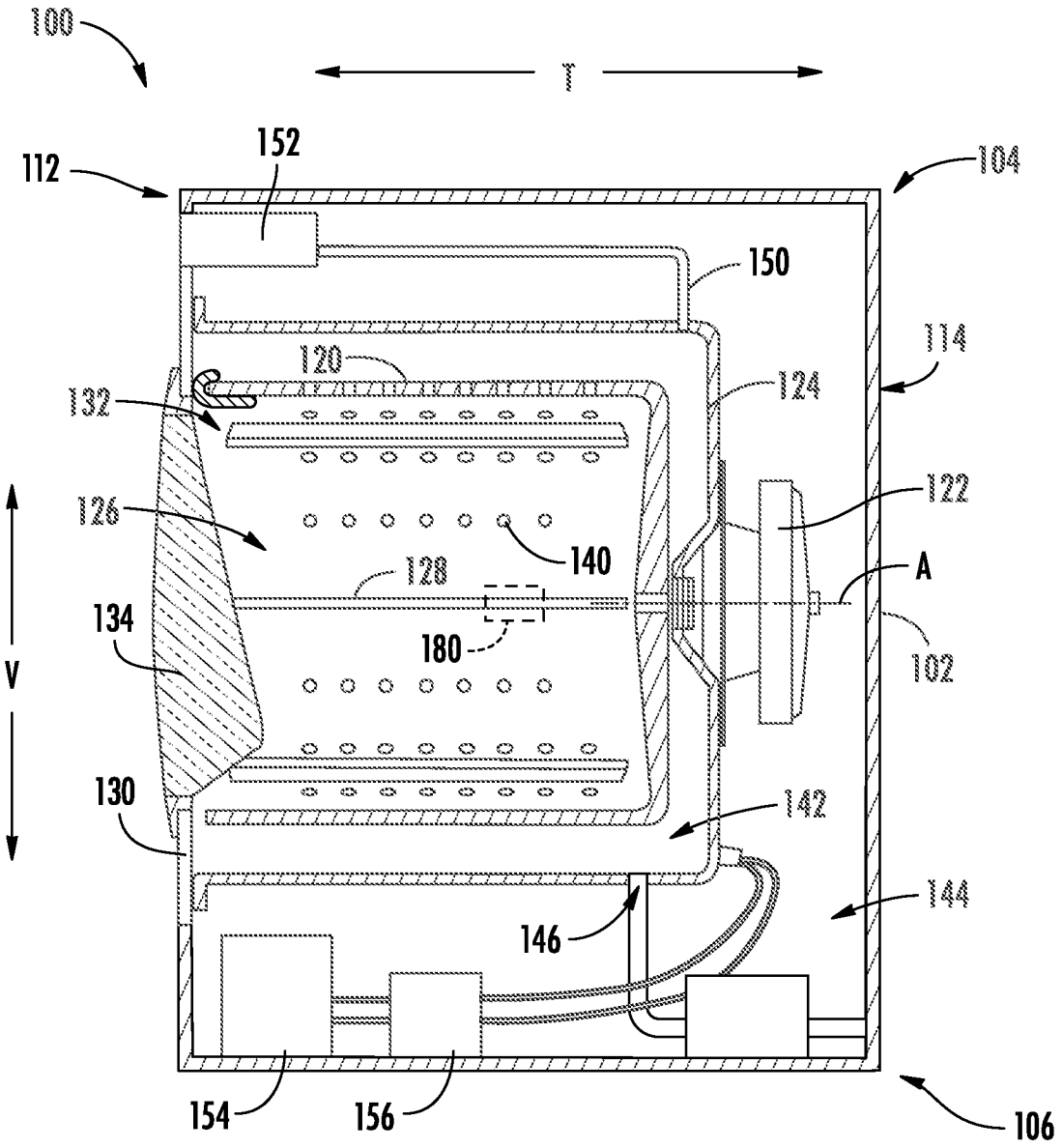
FIG. 4 provides a cross-sectional side view of the exemplary washing machine appliance of FIG. 3.

FIG. 3 is a perspective view of an exemplary horizontal axis washing machine appliance 100 and FIG. 4 is a side cross-sectional view of washing machine appliance 100. As illustrated, washing machine appliance 100 generally defines a vertical direction V, a lateral direction L, and a transverse direction T, each of which is mutually perpendicular, such that an orthogonal coordinate system is generally defined. Washing machine appliance 100 includes a cabinet 102 that extends between a top 104 and a bottom 106 along the vertical direction V, between a left side 108 and a right side 110 along the lateral direction L, and between a front 112 and a rear 114 along the transverse direction T.

Referring to FIG. 4, a wash tub 124 is positioned within cabinet 102 and is generally configured for retaining wash fluids during an operating cycle. As used herein, "wash fluid" may refer to water, detergent, fabric softener, bleach, or any other suitable wash additive or combination thereof. Wash tub 124 is substantially fixed relative to cabinet 102 such that it does not rotate or translate relative to cabinet 102.

A wash basket 120 is received within wash tub 124 and defines a wash chamber 126 that is configured for receipt of articles for washing. More specifically, wash basket 120 is rotatably mounted within wash tub 124 such that it is rotatable about an axis of rotation A. According to the illustrated embodiment in FIGS. 3 and 4, the axis of rotation A is substantially parallel to the transverse direction T. In this regard, washing machine appliance 100 is generally referred to as a "horizontal axis" or "front load" washing machine appliance 100. However, it should be appreciated that aspects of the present subject matter may be used within the context of a vertical axis or top load washing machine appliance as well.

Wash basket 120 may define one or more agitator features that extend into wash chamber 126 to assist in agitation and cleaning of articles disposed within wash chamber 126 during operation of washing machine appliance 100. For example, as illustrated in FIG. 4, a plurality of ribs 128 extends from basket 120 into wash chamber 126. In this manner, for example, ribs 128 may lift articles disposed in wash basket 120 during rotation of wash basket 120.

Washing machine appliance 100 includes a motor assembly 122 that is in mechanical communication with wash basket 120 to selectively rotate wash basket 120 (e.g., during an agitation or a rinse cycle of washing machine appliance 100). According to the illustrated embodiment, motor assembly 122 is a pancake motor. However, it should be appreciated that any suitable type, size, or configuration of motor may be used to rotate wash basket 120 according to alternative embodiments.

Referring generally to FIGS. 3 and 4, cabinet 102 also includes a front panel 130 that defines an opening 132 that permits user access to wash basket 120 of wash tub 124. More specifically, washing machine appliance 100 includes a door 134 that is positioned over opening 132 and is rotatably mounted to front panel 130 (e.g., about a door axis that is substantially parallel to the vertical direction V). In this manner, door 134 permits selective access to opening 132 by being movable between an open position (not shown) facilitating access to a wash tub 124 and a closed position (FIG. 3) prohibiting access to wash tub 124.

In some embodiments, a window 136 in door 134 permits viewing of wash basket 120 when door 134 is in the closed position (e.g., during operation of washing machine appliance 100). Door 134 also includes a handle (not shown) that, for example, a user may pull when opening and closing door 134. Further, although door 134 is illustrated as mounted to front panel 130, it should be appreciated that door 134 may be mounted to another side of cabinet 102 or any other suitable support according to alternative embodiments. Additionally or alternatively, a front gasket or baffle 138 may extend between tub 124 and the front panel 130 about the opening 132 covered by door 134, further sealing tub 124 from cabinet 102.

Referring again to FIG. 4, wash basket 120 also defines a plurality of perforations 140 in order to facilitate fluid communication between an interior of basket 120 and wash tub 124. A sump 142 is defined by wash tub 124 at a bottom of wash tub 124 along the vertical direction V. Thus, sump 142 is configured for receipt of, and generally collects, wash fluid during operation of washing machine appliance 100. For example, during operation of washing machine appliance 100, wash fluid may be urged (e.g., by gravity) from basket 120 to sump 142 through the plurality of perforations 140. A pump assembly 144 is located beneath wash tub 124 for gravity assisted flow when draining wash tub 124 (e.g., via a drain 146). Pump assembly 144 is also configured for recirculating wash fluid within wash tub 124.

Still referring to FIGS. 3 and 4, in some embodiments, washing machine appliance 100 includes an additive dispenser or spout 150. For example, spout 150 may be in fluid communication with a water supply (not shown) in order to direct fluid (e.g., clean water) into wash tub 124. Spout 150 may also be in fluid communication with the sump 142. For example, pump assembly 144 may direct wash fluid disposed in sump 142 to spout 150 in order to circulate wash fluid in wash tub 124.

As illustrated, a detergent drawer 152 may be slidably mounted within front panel 130. Detergent drawer 152 receives a wash additive (e.g., detergent, fabric softener, bleach, or any other suitable liquid or powder) and directs the fluid additive to wash chamber 126 during operation of washing machine appliance 100. According to the illustrated embodiment, detergent drawer 152 may also be fluidly coupled to spout 150 to facilitate the complete and accurate dispensing of wash additive.

In optional embodiments, a bulk reservoir 154 is disposed within cabinet 102. Bulk reservoir 154 may be configured for receipt of fluid additive for use during operation of washing machine appliance 100. Moreover, bulk reservoir 154 may be sized such that a volume of fluid additive sufficient for a plurality or multitude of wash cycles of washing machine appliance 100 (e.g., five, ten, twenty, fifty, or any other suitable number of wash cycles) may fill bulk reservoir 154. Thus, for example, a user can fill bulk reservoir 154 with fluid additive and operate washing machine appliance 100 for a plurality of wash cycles without refilling bulk reservoir 154 with fluid additive. A reservoir pump 156 is configured for selective delivery of the fluid additive from bulk reservoir 154 to wash tub 124.

A control panel 160 including a plurality of input selectors 162 is coupled to front panel 130. Control panel 160 and input selectors 162 collectively form a user interface input for operator selection of machine cycles and features. For example, in one embodiment, a display 164 indicates selected features, a countdown timer, or other items of interest to machine users.

Operation of washing machine appliance 100 is controlled by a controller or processing device 166 that is operatively coupled to control panel 160 for user manipulation to select washing machine cycles and features. In response to user manipulation of control panel 160, controller 166 operates the various components of washing machine appliance 100 to execute selected machine cycles and features.

Controller 166 may include a memory (e.g., non-transitive memory) and microprocessor, such as a general or special purpose microprocessor operable to execute programming instructions or micro-control code associated with a wash operation. The memory may represent random access memory such as DRAM, or read only memory such as ROM or FLASH. In one embodiment, the processor executes programming instructions stored in memory. The memory may be a separate component from the processor or may be included onboard within the processor. Alternatively, controller 166 may be constructed without using a microprocessor (e.g., using a combination of discrete analog or digital logic circuitry, such as switches, amplifiers, integrators, comparators, flip-flops, AND gates, and the like) to perform control functionality instead of relying upon software. Control panel 160 and other components of washing machine appliance 100, such as motor assembly 122 and measurement device 180 (discussed hereinbelow), may be in communication with controller 166 via one or more signal lines or shared communication busses. Optionally, measurement device 180 may be included with controller 166. Moreover, measurement devices 180 may include a microprocessor that performs the calculations specific to the measurement of motion with the calculation results being used by controller 166. It should be noted that controllers as disclosed herein are capable of and may be operable to perform any methods and associated method steps as disclosed herein. For example, in some embodiments, methods disclosed herein may be embodied in programming instructions stored in the memory and executed by the controller.

In exemplary embodiments, during operation of washing machine appliance 100, laundry items are loaded into wash basket 120 through opening 132, and a wash operation is initiated through operator manipulation of input selectors 162. For example, a wash cycle may be initiated such that wash tub 124 is filled with water, detergent, or other fluid additives (e.g., via additive dispenser 150). One or more valves (not shown) can be controlled by washing machine appliance 100 to provide for filling wash basket 120 to the appropriate level for the amount of articles being washed or rinsed. By way of example, once wash basket 120 is properly filled with fluid, the contents of wash basket 120 can be agitated (e.g., with ribs 128) for an agitation phase of laundry items in wash basket 120. During the agitation phase, the basket 120 may be motivated about the axis of rotation A at a set speed (e.g., a tumble speed). As the basket 120 is rotated, articles within the basket 120 may be lifted and permitted to drop therein.

After the agitation phase of the washing operation is completed, wash tub 124 can be drained. Laundry articles can then be rinsed (e.g., through a rinse cycle) by again adding fluid to wash tub 124, depending on the particulars of the cleaning cycle selected by a user. Ribs 128 may again provide agitation within wash basket 120. One or more spin cycles may also be used. In particular, a spin cycle may be applied after the wash cycle or after the rinse cycle in order to wring wash fluid from the articles being washed. During a spin cycle, basket 120 is rotated at relatively high speeds. For instance, basket 120 may be rotated at one fixed speed or set speed (e.g., a pre-plaster speed) before being rotated at another fixed speed or set speed (e.g., a plaster speed). As would be understood, the pre-plaster speed may be greater than the tumble speed and the plaster speed may be greater than the pre-plaster speed. Moreover, agitation or tumbling of articles may be reduced as basket 120 increases its rotational velocity such that the plaster speed maintains the articles at a generally fixed position relative to basket 120.

After articles disposed in wash basket 120 are cleaned (or the washing operation otherwise ends), a user can remove the articles from wash basket 120 (e.g., by opening door 134 and reaching into wash basket 120 through opening 132).

As mentioned above, one or more measurement devices 180 may be provided in the washing machine appliance 50 or 100 for measuring movement of the tub 64 or 124, in particular during rotation of articles in the spin cycle of the washing operation. Measurement devices 180 may measure a variety of suitable variables that can be correlated to movement of the tub 64 or 124. The movement measured by such devices 180 can be utilized to monitor the load balance state of the tub and to facilitate agitation or basket rotation in particular manners or for particular time periods to adjust the load balance state (e.g., as an attempt to balance articles within the basket 70 or 120 and/or to reduce the likelihood of an out-of-balance condition by limiting the rotation speed).

A measurement device 180 in accordance with the present disclosure may include an accelerometer which measures translational motion, such as acceleration along one or more directions. Additionally or alternatively, a measurement device 180 may include a gyroscope, which measures rotational motion, such as rotational velocity about an axis. A measurement device 180 in accordance with the present disclosure is mounted to the tub 64 or 124 (e.g., on sidewall 68 of tub 64 as illustrated in FIG. 2) to sense movement of the tub 64 or 124 relative to the cabinet 52 or 102 by measuring uniform periodic motion, non-uniform periodic motion, or excursions of the tub during operation of the washing machine appliance 50 or 100. For instance, movement may be measured as discrete identifiable components (e.g., in a predetermined direction).

In exemplary embodiments, a measurement device 180 may include at least one gyroscope or at least one accelerometer. The measurement device 180, for example, may be a printed circuit board that includes the gyroscope and accelerometer thereon. The measurement device 180 may be mounted to the tub (e.g., via a suitable mechanical fastener, adhesive, etc.) and may be oriented such that the various sub-components (e.g., the gyroscope and accelerometer) are oriented to measure movement along or about particular directions as discussed herein. Notably, the gyroscope and accelerometer in exemplary embodiments are advantageously mounted to the tub at a single location (e.g., the location of the printed circuit board or other component of the measurement device 180 on which the gyroscope and accelerometer are grouped). Such positioning at a single location advantageously reduces the costs and complexity (e.g., due to additional wiring, etc.) of out-of-balance detection, while still providing relatively accurate out-of-balance detection as discussed herein. Alternatively, however, the gyroscope and accelerometer need not be mounted at a single location. For example, a gyroscope located at one location on tub can measure the rotation of an accelerometer located at a different location on tub, because rotation about a given axis is the same everywhere on a solid object such as tub.

Figure 5:
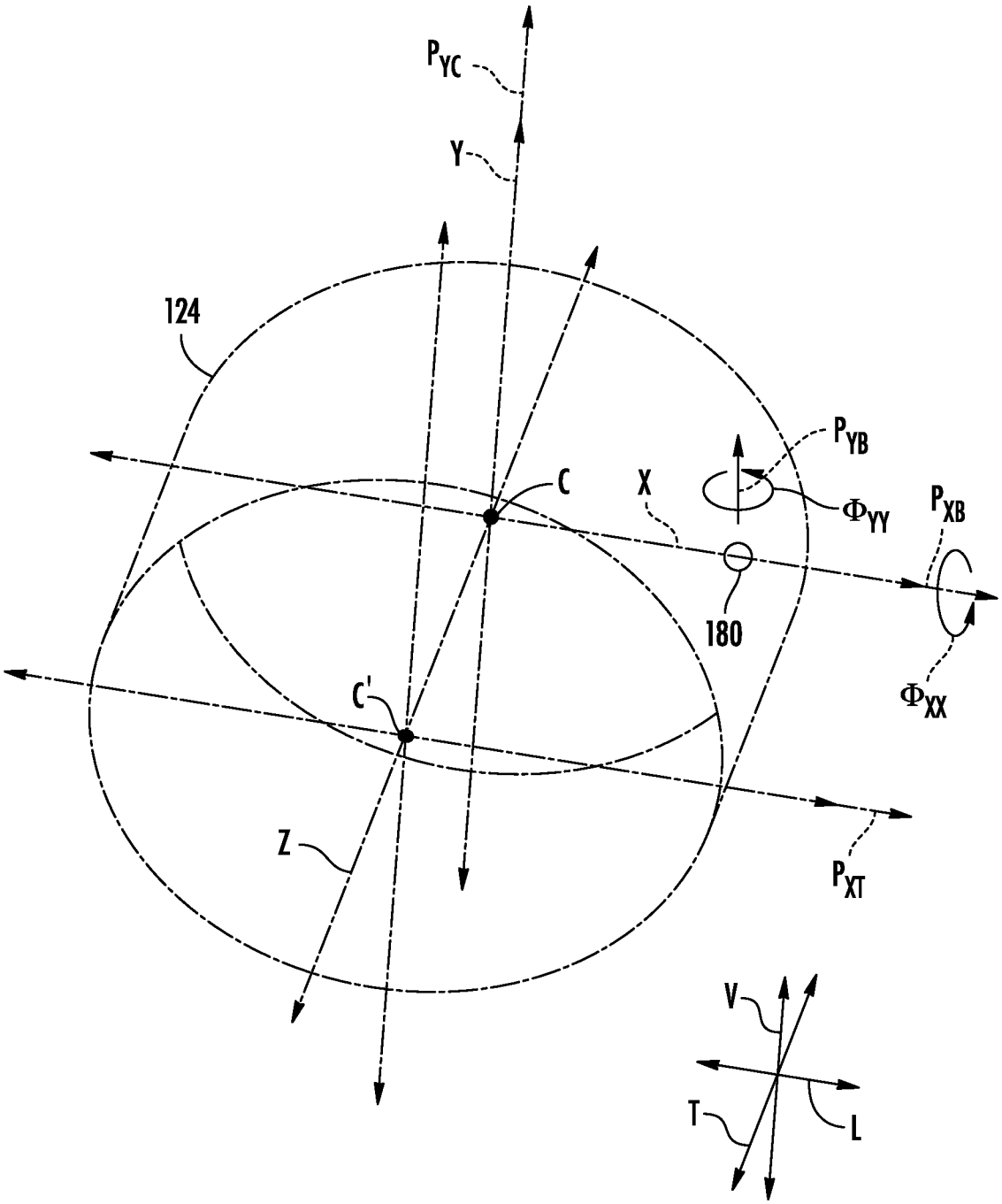
FIG. 5 provides a schematic perspective view of components of a washing machine appliance in accordance with exemplary embodiments of the present disclosure.
Figure 6:
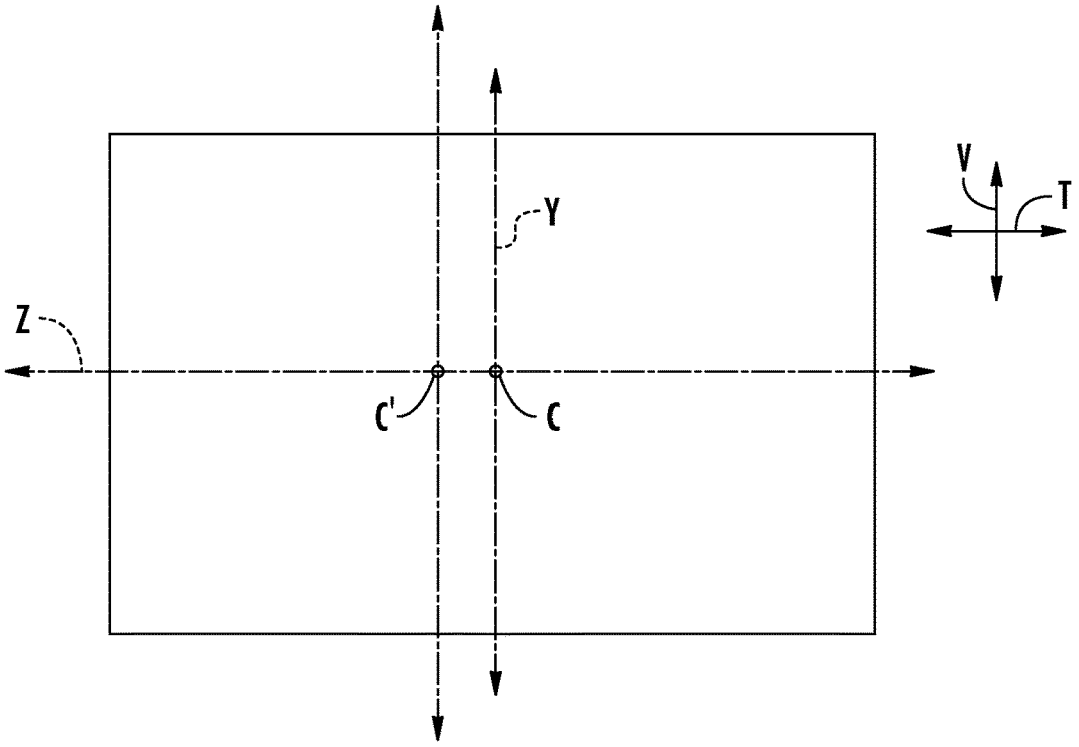
FIG. 6 provides a schematic side view of components of a washing machine appliance in accordance with exemplary embodiments of the present disclosure.
Figure 7:
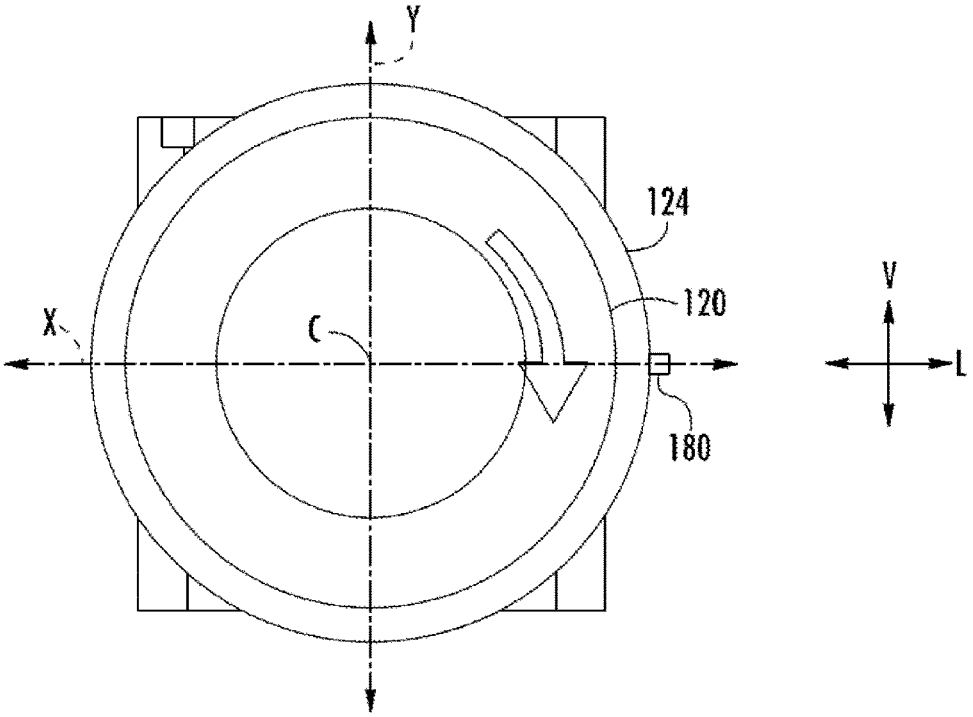
FIG. 7 provides a schematic end view of components of a washing machine appliance in accordance with exemplary embodiments of the present disclosure.

Turning now to FIGS. 5-7, a particular example of a measurement device 180 and possible measurements taken thereby is illustrated with reference to an exemplary washing machine appliance which is a horizontal-axis washing machine appliance, such as the washing machine appliance 100 of FIGS. 3 and 4. In additional embodiments, the measurement device 180 and associated measurements described below with reference to FIGS. 5-7 may also be used with a different washing machine appliance, e.g., a vertical-axis washing machine appliance such as washing machine appliance 50 of FIGS. 1 and 2.

As illustrated, tub 124 may define an X-axis, a Y-axis, and a Z-axis that are mutually orthogonal to each other. The Z-axis may extend along a longitudinal direction, and may thus be coaxial or parallel with the axis of rotation A (as seen, e.g., in FIG. 2 or FIG. 4) when the tub 124 and basket 120 are balanced. Thus, while the Z-axis in the example embodiments illustrated in FIGS. 5-7 is generally parallel with the transverse direction T, in other embodiments, e.g., a vertical-axis washing machine such as washing machine appliance 50 of FIGS. 1 and 2, the Z-axis may be generally parallel with the vertical direction V, for example. Movement of the tub 124 measured by measurement device(s) 180 may, in exemplary embodiments, be measured (e.g., approximately measured) as a displacement amplitude or value.

In some embodiments, movement is measured as a plurality of unique displacement values. Optionally, the displacement values may occur in discrete channels of motion (e.g., as distinct directional components of movement). For instance, displacement values may correspond to one or more indirectly measured movement components perpendicular or approximately perpendicular to a center C (e.g., geometric center of gravity based on the shape and mass of tub 124 in isolation) of the tub 124. Such movement components may, for example, occur in a plane defined by the X-axis and Y-axis (i.e., the X-Y plane) or in a plane perpendicular to the X-Y plane. Movement of the tub 124 along the particular direction may be calculated using the indirect measurement component and other suitable variables, such as a horizontal or radial offset distance along the vector from the measurement device 180 to the center C of the tub 124. Additionally or alternatively, the displacement values may correspond to one or more directly measured movement components. Such movement components may, for example, occur in the X-Y plane or in a plane perpendicular to the X-Y plane.

The measured movement of the tub 124 in accordance with exemplary embodiments of the present disclosure, such as those requiring one or more gyroscopes and one or more accelerometers, may advantageously be calculated based on the movement components measured by the accelerometer or gyroscope of the measurement device(s) 180. For example, a movement component of the tub 124 may be a linear displacement vector $P_{XB}$ (e.g., a first displacement vector) of center C in the X-Y plane (e.g., along the lateral direction L). Displacement vector $P_{XB}$ may be calculated from detected movement by the accelerometer at measurement device 180 (e.g., via double integration of detected acceleration data). For example, vectors defined in an X-Y plane such as $P_{XB}$ may represent the radius of a substantially circular (e.g., elliptical, orbital, or perfectly circular) motion caused by the rotation of an imbalanced load so that maximum and minimum values of the periodic vector occur as the substantially circular motion aligns with the direction of the vector.

In additional or alternative embodiments, another movement component of tub 124 is obtained at measurement device 180. For instance, a wobble angle $\phi_{YY}$ of angular displacement of the tub 124 may be calculated. Wobble angle $\phi_{YY}$ may represent rotation relative to the axis of rotation A (FIG. 2 or FIG. 4) such as the angle of deviation of the Z-axis from its static or balanced position around the axis of rotation A. Wobble angle $\phi_{YY}$ may be calculated as a rotation parallel to the Y-axis using movement detected by the gyroscope at measurement device 180 (e.g., via integration of detected rotational velocity data).

In still further additional or alternative embodiments, a movement component of tub 124 may be a linear displacement vector $P_{XT}$ (e.g., a second displacement vector) of a center C' (e.g., effective center of gravity that compensates for biasing or resistance forces on tub 124 from one or more directions) in a plane parallel to the X-Y plane and perpendicular to the axis of rotation A (FIG. 2 or FIG. 4) (e.g., along the lateral direction L). Displacement vector $P_{XT}$ may thus be separated from the displacement vector $P_{XB}$ along the Z-axis. Optionally, the vector $P_{XT}$ may be calculated from movement detected at the accelerometer or gyroscope at measurement device 180. For example, displacement vector $P_{XT}$ may be calculated as a cross-product (e.g., the rotation at $\phi_{YY}$ times the transverse offset distance between measurement device 180 and C') added to another displacement vector (e.g., $P_{XB}$).

Notably, the term "approximately" as utilized with regard to the orientation and position of such movement measurements denotes ranges such as of plus or minus two inches (2") or plus or minus ten degrees (10°) relative to various axes passing through the basket center C which minimizes, for example, the contribution to error in the measurement result by rotation about the Z-axis, as might be caused, for example, by a torque reaction to motor assembly 122.

Further, and as discussed, the measurement device 180 need not be in the X-Y plane in which movement (e.g., at the center C) is calculated. For example, measurement device 180 may additionally be offset by an offset distance along the Z-axis. In one particular example, a measurement device 180 mounted in such an offset location may be utilized to indirectly measure movement of the center C in an X-Y plane at or proximate the top of the tub 124. Additionally or alternatively, a measurement device 180 can be mounted close to or on the Z-axis or may be used to calculate motion that is not on the axis of rotation A (FIG. 2 or FIG. 4).

In some embodiments, an out-of-balance (OOB) value may be determined, at least in part, from the movement measured from measurement device 180. For instance, controller 166 may correlate displacement (e.g., as measured in inches) and rotational velocity (e.g., as measured at motor assembly 122 in rotations per minute) to an OOB value, such as a value of weight or mass (e.g., in pounds-mass). Advantageously, the determined OOB value may provide an accurate indicator of an imbalance that accounts for both displacement and rotation. In some such embodiments, a predetermined graph, table, or transfer function may be provided to determine a specific OOB value using a known or measured displacement value and rotational velocity. The predetermined graph, table, or transfer function may be determined from experimental data and, optionally, included within controller 166. As an example, the OOB value may be determined from a transfer function provided as $$OOB=P_{XT}*(Q_1*V_R+Q_2)+(Q_3*V_R)-Q_4$$

wherein:

$P_{XT}$ is a measured displacement;

$V_R$ is a measured or otherwise known rotational velocity; and $Q_1$, $Q_2$, $Q_3$, and $Q_4$ are each unique predetermined coefficients relating to the corresponding washer appliance.

In optional embodiments, controller 166 may gather multiple OOB values (e.g., continuously or over a set period of time). From these multiple OOB values, controller 166 may determine a rate of change for the OOB values. For instance, controller 166 may calculate a rate of change across multiple OOB values spanning a sub-period of time. Additionally or alternatively, controller 166 may graph the OOB values and determine a slope of the graphed values at a specific point in time. Thus, in various embodiments, a relative displacement value or relative OOB value may be calculated based on one or both of the rate of change and/or the slope.

Figure 8:
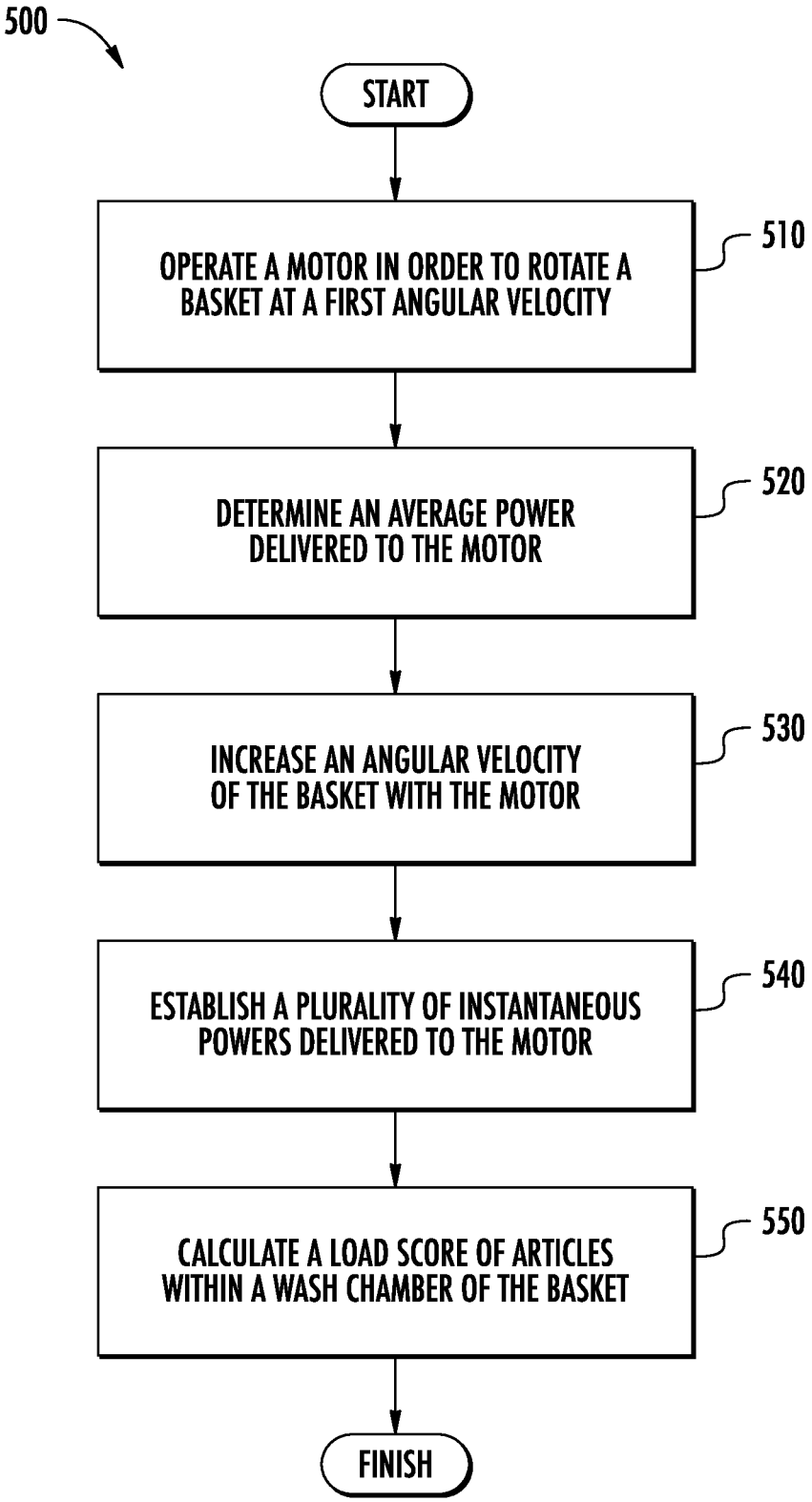
FIG. 8 provides a flow chart illustrating a method for evaluating a load of articles in a washing machine appliance according to an exemplary embodiment of the present subject matter.

FIG. 8 illustrates a method 500 for operating a washing machine appliance according to an exemplary embodiment of the present subject matter. Method 500 can be used to operate any suitable washing machine appliance, such as the washing machine appliance 50 of FIGS. 1 and 2 or washing machine appliance 100 of FIGS. 3 and 4. For the sake of simplicity, method 500 will be described herein with particular reference to washing machine appliance 50, by way of example only and without limiting the method 500 to any specific washing machine appliance configuration.

Figure 9:
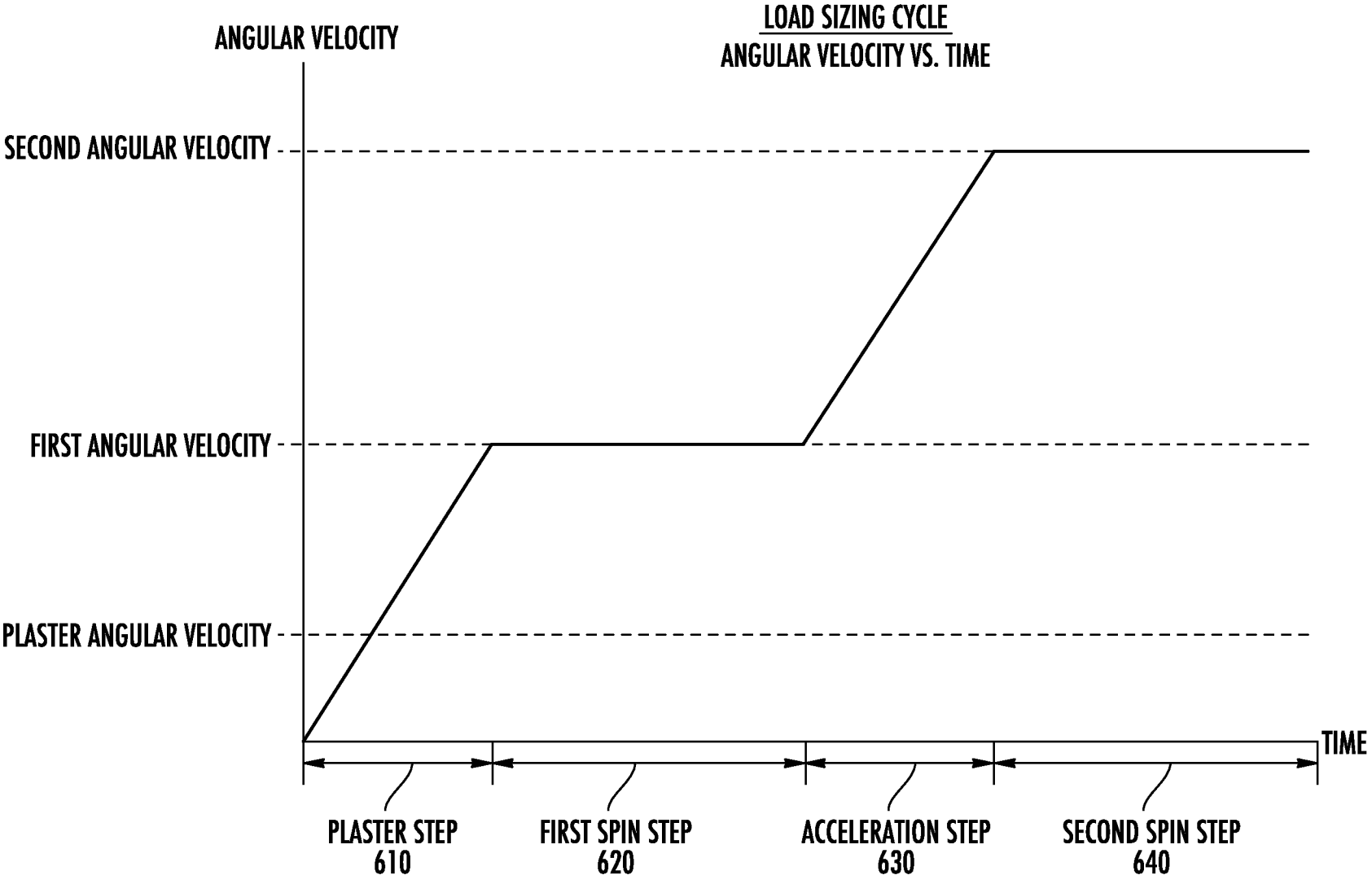
FIG. 9 provides an exemplary plot of an angular velocity of a basket over time during an exemplary operation of a washing machine appliance.

For example, controller 40 may be programmed or configured to implement method 500. As another example, method 500 may be used to operate washing machine appliance 50 (FIGS. 1 and 2). Utilizing method 500, a load size of articles within wash chamber 73 of basket 70 (FIG. 2) may be estimated or measured. In particular, a mass of articles within the wash chamber 73 of the basket 70 may be estimated or measured, at least in part, utilizing method 500. FIG. 9 provides a plot of an angular velocity of basket 70 over time during a load sizing cycle of washing machine appliance 50. Method 500 can be performed during the load sizing cycle of washing machine appliance 50 shown in FIG. 9. Method 500 is discussed in greater detail below in the context of the load sizing cycle illustrated in FIG. 9.

As may be seen in FIG. 9, the load sizing cycle includes a plaster step 610. During plaster step 610, controller 40 operates motor 94. In particular, motor 94 can accelerate basket 70 such that an angular velocity of basket 70 increases, e.g., to about a first angular velocity, during the plaster step 610. The first angular velocity can be any suitable angular velocity. For example, the first angular velocity may be greater than a plaster angular velocity of articles within wash chamber 73 of basket 70. Thus, when motor 94 rotates basket 70 at the first angular velocity, articles within wash chamber 73 of basket 70 can be plastered against and/or stick to basket 70 because the angular velocity of basket 70 exceeds the plaster angular velocity of basket 70. With articles within wash chamber 73 of basket 70 plastered against basket 70, articles within wash chamber 73 can be substantially stationary or fixed relative to basket 70 during rotation of basket 70.

At step 510 (FIG. 8), controller 40 operates motor 94 in order to rotate basket 70 at the first angular velocity. At step 520, controller 40 determines an average power delivered to motor 94, e.g., during step 510. For example, as shown in FIG. 9, motor 94 rotates basket 70 at the first angular velocity during a first spin step 620 of the load sizing cycle. At step 520, controller 40 can determine the average power delivered to motor 94 during the entirety of the first spin step 620 or during a portion of the first spin step 620. As will be understood by those skilled in the art, a power delivered to motor 94 when basket 70 is rotating at a constant angular velocity can correspond to about a power required to overcome friction and other static factors hindering rotation of basket 70, e.g., because basket 70 is not accelerating. Thus, the average power delivered to motor 94 determined at step 520 can be used to estimate or gauge the friction and other steady-state losses within motor 94 and other components of washing machine appliance 50 that impede rotation of basket 70.

At step 530, the angular velocity of basket 70 is increased. As an example, controller 40 can operate motor 94 in order to increase the angular velocity of basket 70, e.g., after step 510. In particular, controller 40 can increase the angular velocity of basket 70 from about the first angular velocity to about a second angular velocity with motor 94 at step 530. The second angular velocity can be any suitable angular velocity. For example, the second angular velocity may be greater than the first angular velocity.

At step 540, controller 40 establishes a plurality of instantaneous powers delivered to motor 94, e.g., during step 530. As an example, an instantaneous power may be measured about every ten milliseconds during step 530 in order to establish the plurality of instantaneous powers delivered to motor 94 at step 540. As may be seen in FIG. 9, motor 94 increases the angular velocity of basket 70 from about the first angular velocity to about the second angular velocity during an acceleration step 630 of the load sizing cycle. At step 540, controller 40 can determine the plurality of instantaneous powers delivered to motor 94 during the entirety of the acceleration step 630 or during a portion of the acceleration step 630. As will be understood by those skilled in the art, the power delivered to motor 94 when basket 70 is accelerating can correspond to about a power required to overcome friction and other static factors hindering rotation of basket 70 as well as the power required to accelerate basket 70. Thus, each instantaneous power delivered to motor 94 during step 530 can be used to estimate or gauge the power required to accelerate basket 70 after accounting for the friction and other steady-state losses within motor 94 and other components of laundry appliance 50 that impede rotation of basket 70.

At step 550, controller 40 calculates a load score of articles within wash chamber 73 of basket 70 based at least in part on the average power delivered to motor 94 during step 520 and the plurality of instantaneous powers delivered to motor 94 during step 530. The load score is, e.g., directly, proportional to a load size of articles within wash chamber 73 of basket 70. As an example, the load score of articles within wash chamber 73 of basket 70 may be calculated with the following at step 550, $$\text{Load Score} = \sum_{t_0}^{t_1}\left(P(t) - P_{avg,ss} * \frac{n(t)}{n_{avg,ss}}\right)$$

where

P is an instantaneous power delivered to motor 94 at time t during step 530, $P_{avg,ss}$ is the average power delivered to motor 94 during step 510, n is an angular velocity of basket 70 at time t during step 530, and $n_{avg,ss}$ is the first angular velocity.

Thus, the load score of articles within wash chamber 73 of basket 70 can correspond to a sum of the difference between each instantaneous power delivered to motor 94 at step 530 and a product of the average power delivered to motor 94 during step 510 and a weighting or scaling factor, where the weighting factor is a quotient of the angular velocity of basket 70 at time t and the first angular velocity.

In additional embodiments, the load score may be calculated based on only the plurality of instantaneous powers and/or only on the average power. Moreover, such power measurements may be taken at various steps in the process, such as a plurality of instantaneous powers may also or instead be taken while rotating the basket at a constant speed, e.g., during step 510, and/or an average power may be determined while increasing the angular velocity of the basket, e.g., during step 530. For example, some embodiments may include calculating a load score using an equation similar to the example provided above, but without the average power, e.g., without the $P_{avg,ss}$ and $n_{avg,ss}$ terms, where each of the plurality of instantaneous powers is multiplied by the corresponding angular velocity, e.g., the angular velocity at the same time (t) as the instantaneous power, and, in such exemplary embodiments, the load score may be a summation of such products. Additional embodiments may include other operations in addition to or instead of the multiplication operations described above, e.g., so long as the load score is calculated consistently from load to load whereby the load score may be used to determine a relative size of each load, such as to distinguish between large loads and small loads, etc.

The load score of articles within wash chamber 73 of basket 70 can be directly proportional to a mass, m, of articles within wash chamber 73 of basket 70 such that $$m \propto \text{Load Score}$$

Thus, method 500 can also include correlating the load score of articles within wash chamber 73 of basket 70 to the mass of articles within wash chamber 73 of basket 70. For example, controller 40 can obtain an associated mass of the load score from a lookup table or a function, such as a transfer function, within the memory of controller 40.

It should be understood that method 500 can also include repeating steps 510, 520, 530, 540 and 550 and calculating an average load score for articles within wash chamber 73 of basket 70. Repeating steps 510-550 can improve the accuracy and/or consistency of method 500. However, repeating steps 510, 520, 530, 540 and 550 can increase a duration or time interval of method 500.

Moreover, it should be understood that the illustrated steps of FIGS. 8 and 9 are exemplary only and not limiting. In various embodiments of the present disclosure, the illustrated steps may be performed in different orders, some steps may be omitted, and/or additional steps may be included. For example, some embodiments may include accelerating and/or decelerating the basket at various stages before arriving at the last speed at which the power measurements are taken.

Figure 10:
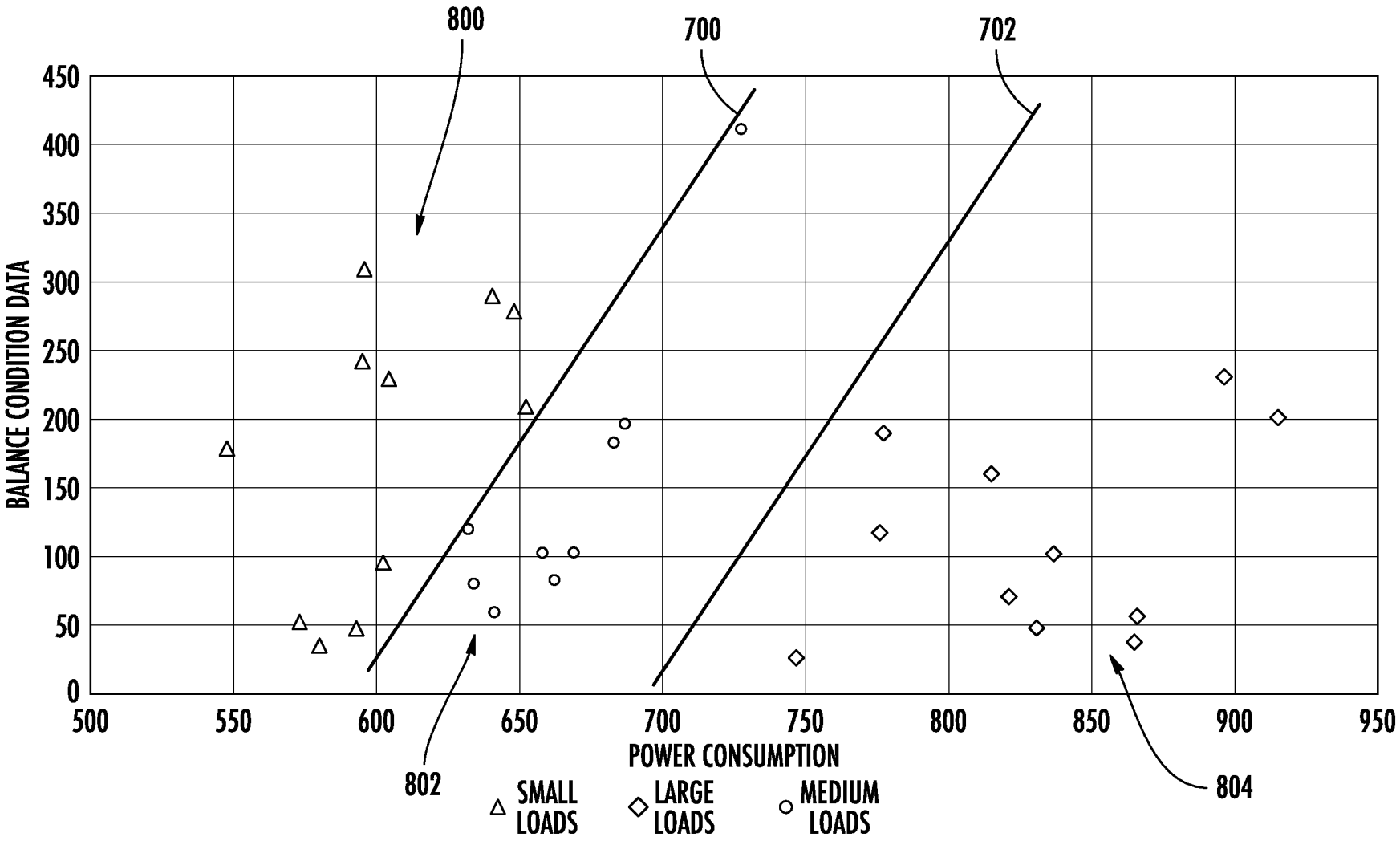
FIG. 10 provides a graph of exemplary load size data based on power consumptions and balance conditions for a plurality of exemplary loads of varying sizes.

FIG. 10 illustrates a plurality of data points, each data point corresponding to one load of a plurality of loads, where the loads have varying sizes. More particularly, FIG. 10 illustrates the data points with balance condition data plotted on the vertical axis and power consumption plotted on the horizontal axis of FIG. 10. The balance condition data may be measured using one or more measurement devices, e.g., accelerometers and/or gyroscopes. The balance condition data may be a displacement measurement, such as a linear displacement or an angular displacement, or the balance condition data may be a load score, such as an OOB value, derived from multiple displacement measurements, e.g., as described above. The power consumption data may include one or more instantaneous powers and/or average power values, such as the power consumption may correspond to a load score or average load score that is proportional to the mass of the load of articles, as described above.

Accordingly, a size of each load of articles may be determined based on the power consumption and the balance condition, e.g., by determining where the combined balance condition data and power consumption data for each particular load falls with respect to one or more thresholds, such as the exemplary low threshold 700 and high threshold 702 illustrated in FIG. 10. For example, FIG. 10 illustrates a plurality of small loads 800 (depicted by triangular data point markers in FIG. 10) which are less than the low threshold 700, a plurality of medium loads 802 (depicted by circular data point markers in FIG. 10) which are greater than the low threshold 700 and less than the high threshold 702, and a plurality of large loads 804 (depicted by square data point markers in FIG. 10) which are greater than the high threshold 702. For example, the low threshold may be between zero pounds (0 lbs.) and about four pounds (4 lbs.) or less, such as about three pounds (3 lbs.), and the high threshold may be between about five pounds (5 lbs.) and about nine pounds (9 lbs.) or more, such as about seven and a half pounds (7.5 lbs.). In various embodiments, only one threshold may be applied, such as distinguishing small loads from all other loads, or distinguishing large loads from all other loads, or more than two thresholds may be applied.

Figure 11:
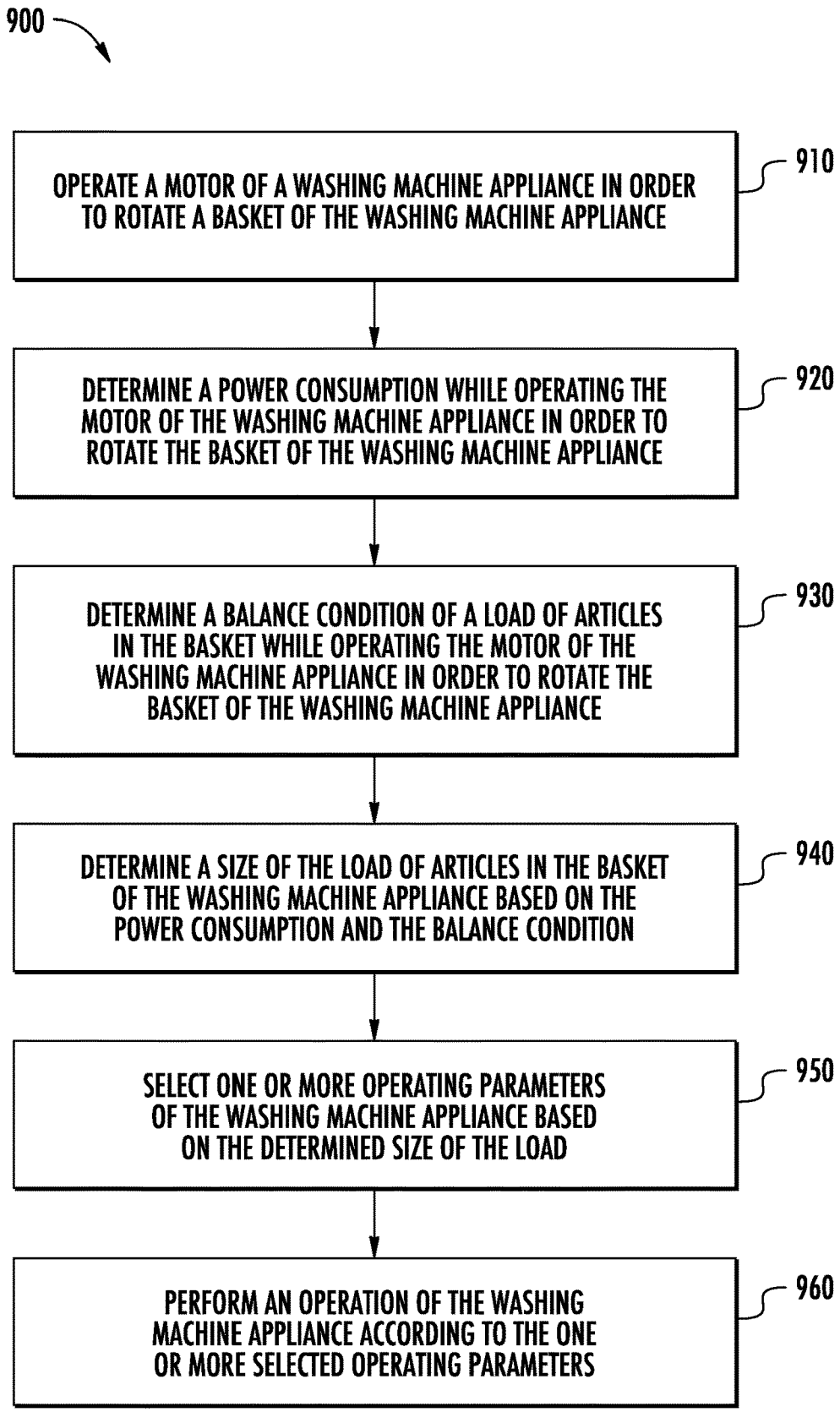
FIG. 11 provides a flow chart illustrating a method for operating a washing machine appliance in accordance with one or more additional exemplary embodiments of the present disclosure.

Turning now to FIG. 11, embodiments of the present disclosure may also include methods of operating a washing machine appliance, such as the example method 900 illustrated in FIG. 11. Such methods may be used with any suitable washing machine appliance, such as washing machine appliance 50 or 100, as described above.

For example, as mentioned above, the washing machine appliance 50 or 100 may include a controller 40 or 166 and the controller 40 or 166 may be operable for, e.g., configured for, performing some or all of the method steps. For example, one or more method steps may be embodied as an algorithm or program stored in a memory of the controller 40 or 166 and executed by the controller 40 or 166 in response to a user input such as a selection of a wash operation or rinse operation, etc., of the washing machine appliance 50 or 100.

As illustrated in FIG. 11, in some embodiments, the method 900 may include a step 910 of operating a motor of the washing machine appliance in order to rotate a basket of the washing machine appliance.

Method 900 may also include a step 920 of determining a power consumption while operating the motor of the washing machine appliance in order to rotate the basket of the washing machine appliance. In various exemplary embodiments, the power consumption may include one or more instantaneous powers and/or average powers, e.g., as described above with reference to FIGS. 8 and 9.

Method 900 may further include a step 930 of determining a balance condition of a load of articles in the basket while operating the motor of the washing machine appliance in order to rotate the basket of the washing machine appliance. For example, in some embodiments, determining the balance condition may include measuring movement of a tub of the washing machine appliance while operating the motor of the washing machine appliance in order to rotate the basket of the washing machine appliance using one or more measurement devices. Such measurement devices may include one or more accelerometers and/or gyroscopes, e.g., as described above with reference to FIGS. 5-7.

In various embodiments, the power consumption and balance condition may be determined at the same time, during overlapping time periods while rotating the basket, or at different times, and each may be determined during steady-state rotation and/or during acceleration of the basket. For example, step 920 of operating the motor of the washing machine appliance in order to rotate the basket of the washing machine appliance may include rotating the basket at a fixed speed and/or rotating the basket at a first speed and then accelerating the basket to a second speed greater than the first speed. Thus, for example, the power consumption may be determined while rotating at the fixed speed and/or while accelerating the basket, in various combinations with the balance condition, e.g., the balance condition may also be determined while rotating at the fixed speed and/or while accelerating the basket, at either the same time, overlapping time periods, or a different time than the power consumption is determined. In some exemplary embodiments, the power consumption may be determined while rotating at a fixed speed and the balance condition may be determined while rotating at the fixed speed. In additional exemplary embodiments, the power consumption may be determined while rotating the basket at a steady-state speed and the balance condition may be determined while accelerating the basket. In further exemplary embodiments, the power consumption may be determined while accelerating the basket and the balance condition may be determined while rotating the basket at a steady-state speed. In still further exemplary embodiments, the power consumption may be determined while accelerating the basket and the balance condition may be determined while accelerating the basket.

Method 900 may also include determining a size of the load of articles in the basket of the washing machine appliance based on the power consumption and the balance condition, e.g., as indicated at 940 in FIG. 11. For example, basing the determination of the load size on both the power consumption and the balance condition may advantageously provide a more accurate estimate of the load size. For example, the power consumption may be a function of not only the load size but also of the balance condition, such as the power consumption may be impacted by (e.g., proportional to) the magnitude of out-of-balance of the load of articles in the basket as well as the mass of the load of articles. Accordingly, where the load size determination takes into account both the power consumption and the balance condition, the determined size of the load of articles, e.g., the result of step 940, may be more accurate as compared to determining the load size based solely on the power consumption.

Determining the size of the load of articles may permit responsive or tailored laundry operations. For example, the method 900 may include selecting one or more operating parameters of the washing machine appliance based on the determined size of the load, e.g., as indicated at 950 in FIG. 11, such as to provide optimized handling of the load by applying operating parameters that are custom-tuned or calibrated for the specific amount of laundry, e.g., the size of the load of articles, in the basket. Thus, exemplary embodiments of method 900 may further include performing an operation of the washing machine appliance according to the one or more selected operating parameters, e.g., as indicated at 960 in FIG. 11.

In some embodiments, the determination of the load size may be a high-pass selection of load sizes, such as where load sizes above a certain threshold size receive special treatment or different treatment than loads having a load size below (e.g., less than or equal to) the threshold size. In some embodiments, determining a size of the load of articles in the basket of the washing machine appliance may include determining whether the load is a small load. For example, the washing machine appliance may be configured for, and methods of operating the washing machine appliance may include, detecting a load type of the load of articles in the basket of the washing machine appliance, such as detecting whether the load is a non-shedding load. For example, embodiments of the present disclosure may include a non-shedding load algorithm, which may include detecting a non-shedding load and additional steps to reduce the likelihood of an out-of-balance condition occurring when the non-shedding load is detected, such as limiting the maximum rotation speed of the basket, e.g., during the spin cycle, when the non-shedding load is detected. However, the load type, e.g., non-shedding load, may be more readily detected, such as more easily distinguished from a water shedding load, above a certain load size threshold, e.g., a non-shedding load detection threshold. Thus, in some embodiments, the one or more operating parameters of the washing machine appliance which are selected at 950 may include a non-shedding load detection algorithm, and selecting the one or more operating parameters of the washing machine appliance based on the determined size of the load may include selecting the non-shedding load algorithm when the determined load size is greater than the non-shedding load detection threshold. In such embodiments, performing the operation of the washing machine appliance according to the selected one or more operating parameters may include running the non-shedding load detection algorithm.

In additional embodiments, multiple thresholds or classifications may be applied. Thus, for example, determining the size of the load of articles in the basket of the washing machine appliance may include determining whether the load is a small, medium, or large load, etc., for example, as described above with respect to FIG. 10.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A method of operating a washing machine appliance, the method comprising:

operating a motor of the washing machine appliance in order to rotate a basket of the washing machine appliance;

measuring at least one instantaneous power delivered to the motor while rotating the basket;

determining a power consumption while operating the motor of the washing machine appliance in order to rotate the basket of the washing machine appliance based on the at least one measured instantaneous power delivered to the motor;

determining a balance condition of a load of articles in the basket while operating the motor of the washing machine appliance in order to rotate the basket of the washing machine appliance, wherein determining the balance condition comprises measuring movement of a tub of the washing machine appliance while operating the motor of the washing machine appliance in order to rotate the basket of the washing machine appliance using one or more measurement devices communicatively coupled to the controller;

determining a size of the load of articles in the basket of the washing machine appliance based on the power consumption and the balance condition;

selecting one or more operating parameters of the washing machine appliance based on the determined size of the load; and performing an operation of the washing machine appliance according to the one or more selected operating parameters.

2. The method of claim 1, wherein determining the size of the load of articles comprises determining the size of the load of articles is greater than a non-shedding load detection threshold, wherein the one or more operating parameters of the washing machine appliance comprises a non-shedding load detection algorithm, and wherein performing the operation of the washing machine appliance comprises running the non-shedding load detection algorithm.

3. The method of claim 1, wherein operating the motor of the washing machine appliance in order to rotate the basket of the washing machine appliance comprises rotating the basket at a fixed speed.

4. The method of claim 3, wherein the power consumption is determined while rotating at the fixed speed and wherein the balance condition is determined while rotating at the fixed speed.

5. The method of claim 1, wherein operating the motor of the washing machine appliance in order to rotate the basket of the washing machine appliance comprises rotating the basket at a first speed and then accelerating the basket to a second speed greater than the first speed.

6. The method of claim 5, wherein the power consumption is determined while rotating the basket at a steady-state speed and wherein the balance condition is determined while accelerating the basket.

7. The method of claim 5, wherein the power consumption is determined while accelerating the basket and wherein the balance condition is determined while rotating the basket at a steady-state speed.

8. The method of claim 5, wherein the power consumption is determined while accelerating the basket and wherein the balance condition is determined while accelerating the basket.

9. The method of claim 1, wherein determining the power consumption comprises at least one of determining an average power delivered to the motor while operating the motor of the washing machine appliance in order to rotate the basket of the washing machine appliance and a plurality of instantaneous powers delivered to the motor while operating the motor of the washing machine appliance in order to rotate the basket of the washing machine appliance.

10. The method of claim 1, wherein the one or more measurement devices comprises at least one of an accelerometer and a gyroscope.

11. A washing machine appliance, comprising:

a basket rotatably mounted within the washing machine appliance;

a motor coupled to the basket whereby the motor is operable for rotating the basket;

a controller in operative communication with the motor; and one or more measurement devices communicatively coupled to the controller, the controller configured for:

operating the motor of the washing machine appliance in order to rotate the basket of the washing machine appliance;

measuring at least one instantaneous power delivered to the motor while rotating the basket;

determining a power consumption while operating the motor of the washing machine appliance in order to rotate the basket of the washing machine appliance based on the at least one measured instantaneous power delivered to the motor;

determining a balance condition of a load of articles in the basket while operating the motor of the washing machine appliance in order to rotate the basket of the washing machine appliance, wherein determining the balance condition comprises measuring movement of a tub of the washing machine appliance while operating the motor of the washing machine appliance in order to rotate the basket of the washing machine appliance using the one or more measurement devices;

determining a size of the load of articles in the basket of the washing machine appliance based on the power consumption and the balance condition;

selecting one or more operating parameters of the washing machine appliance based on the determined size of the load; and performing an operation of the washing machine appliance according to the one or more selected operating parameters.

12. The washing machine appliance of claim 11, wherein determining the size of the load of articles comprises determining the size of the load of articles is greater than a non-shedding load detection threshold, wherein the one or more operating parameters of the washing machine appliance comprises a non-shedding load detection algorithm, and wherein performing the operation of the washing machine appliance comprises running the non-shedding load detection algorithm.

13. The washing machine appliance of claim 11, wherein operating the motor of the washing machine appliance in order to rotate the basket of the washing machine appliance comprises rotating the basket at a fixed speed.

14. The washing machine appliance of claim 13, wherein the power consumption is determined while rotating at the fixed speed and wherein the balance condition is determined while rotating at the fixed speed.

15. The washing machine appliance of claim 11, wherein operating the motor of the washing machine appliance in order to rotate the basket of the washing machine appliance comprises rotating the basket at a first speed and then accelerating the basket to a second speed greater than the first speed.

16. The washing machine appliance of claim 15, wherein the power consumption is determined while rotating the basket at a steady-state speed and wherein the balance condition is determined while accelerating the basket.

17. The washing machine appliance of claim 15, wherein the power consumption is determined while accelerating the basket and wherein the balance condition is determined while rotating the basket at a steady-state speed.

18. The washing machine appliance of claim 15, wherein the power consumption is determined while accelerating the basket and wherein the balance condition is determined while accelerating the basket.

19. The washing machine appliance of claim 11, wherein determining the power consumption comprises at least one of determining an average power delivered to the motor while operating the motor of the washing machine appliance in order to rotate the basket of the washing machine appliance and a plurality of instantaneous powers delivered to the motor while operating the motor of the washing machine appliance in order to rotate the basket of the washing machine appliance.

20. The washing machine appliance of claim 11, wherein the one or more measurement devices comprises at least one of an accelerometer and a gyroscope.

* * * * *